US009178271B2

(12) United States Patent
Mo et al.

(10) Patent No.: US 9,178,271 B2
(45) Date of Patent: Nov. 3, 2015

(54) ELECTRONIC DEVICES

(75) Inventors: Dafei Mo, Beijing (CN); Zhaowei Hu, Beijing (CN); Xiongbing Gong, Beijing (CN); Lin Wang, Beijing (CN)

(73) Assignees: Lenovo (Beijing) Limited, Beijing (CN); Beijing Lenovo Software Ltd., Beijing (CN)

( * ) Notice: Subject to any disclaimer, the term of this patent is extended or adjusted under 35 U.S.C. 154(b) by 331 days.

(21) Appl. No.: 13/824,234

(22) PCT Filed: Sep. 27, 2011

(86) PCT No.: PCT/CN2011/080196

§ 371 (c)(1),
(2), (4) Date: Mar. 15, 2013

(87) PCT Pub. No.: WO2012/041213

PCT Pub. Date: Apr. 5, 2012

(65) Prior Publication Data

US 2013/0176181 A1 Jul. 11, 2013

(30) Foreign Application Priority Data

| | | |
|---|---|---|
| Sep. 30, 2010 | (CN) | 2010 1 0502422 |
| Mar. 15, 2011 | (CN) | 2011 1 0062622 |
| Jun. 21, 2011 | (CN) | 2011 1 0167988 |

(51) Int. Cl.

| | |
|---|---|
| ***H01Q 1/24*** | (2006.01) |
| ***H01Q 9/04*** | (2006.01) |
| ***H01Q 5/335*** | (2015.01) |

(52) U.S. Cl.

CPC ..... *H01Q 1/243* (2013.01); *H01Q 1/245* (2013.01); *H01Q 5/335* (2015.01); *H01Q 9/0442* (2013.01)

(58) Field of Classification Search

CPC ..... H01Q 1/243; H01Q 5/335; H01Q 9/0442
USPC ..... 343/702
See application file for complete search history.

(56) References Cited

U.S. PATENT DOCUMENTS

| | | | | |
|---|---|---|---|---|
| 7,009,567 | B2 * | 3/2006 | Iwai et al. | 343/702 |
| 7,733,278 | B2 * | 6/2010 | Kanasaki et al. | 343/702 |
| 8,200,301 | B2 * | 6/2012 | Yamamoto et al. | 455/575.7 |

FOREIGN PATENT DOCUMENTS

| | | | |
|---|---|---|---|
| CN | 1284763 | A | 2/2001 |
| CN | 201440222 | U | 4/2010 |
| TW | 200740028 | A | 10/2007 |

OTHER PUBLICATIONS

International Search Report of the SIPO in international application No. PCT/CN2011/080196 dated Jan. 29, 2012.

* cited by examiner

*Primary Examiner* — Hoang V Nguyen
(74) *Attorney, Agent, or Firm* — Kinney & Lange, P.A.

(57) ABSTRACT

Disclosed are electronic devices. The electronic device includes a metal component configured as an antenna arm, wherein a current delivery path for delivering high-frequency current is formed on the metal component so that the high-frequency current is delivered in accordance with a predetermined path along the current delivery path on the metal component. In this way, the delivery path of the high-frequency current on the antenna can be adjusted to satisfy requirement on antenna performance.

13 Claims, 6 Drawing Sheets

ELECTRONIC DEVICES

TECHNICAL FIELD

Embodiments of the present invention relate to the field of antenna technology and in particular to electronic devices.

BACKGROUND

Currently, more and more electronic devices are equipped with ability of wireless networking via mobile communication network access or short-range wireless access such as WiFi.

No matter what way of access to be adopted, the electronic device needs an internal or external antenna for wireless signal transmission/reception.

However, the inventor has discovered that the antenna of existing electronic devices are non-controllable, which is disadvantageous because it may cause certain aspects of the antenna (e.g., antenna performance or radiation pattern) failing to satisfy practical requirement.

SUMMARY

Embodiments of the present invention provide an electronic device to address the foregoing problems of the existing antenna.

As such, an embodiment of the present invention provides an electronic device, including a metal component configured as an antenna arm, wherein a current delivery path configured to deliver high-frequency current is formed on the metal component so that the high-frequency current is delivered in accordance with a predetermined path along the current delivery path on the metal component.

The electronic device may further include: a first housing, which is a conductive housing; a first wireless communication module with a first input interface; a first radio-frequency line with a first terminal and a second terminal, wherein the first terminal of the first radio-frequency line is electrically connected with the first input interface, and the second terminal of the first radio-frequency line is connected with the first housing; wherein the metal component is the first housing.

Optionally, a plurality of parts of the first housing may have different dielectric constants to form the current delivery path.

Optionally, the first housing may be formed of a material with a first dielectric constant or a conductive material. A component formed of a material with a second dielectric constant may be attached to the first housing to form the current delivery path on the first housing.

Optionally, a plurality of current delivery paths may be formed on the first housing and the electronic device may further include: a detection component configured to detect a part of the first housing that is held by or contacts a human being; and a conduction control component configured to turn on an electrical connection between the second terminal of the first radio-frequency line and a first current delivery path. The first current delivery path is a current delivery path outside the part of the first housing that is held by or contacts the human being.

Optionally, the electronic device may further include: a matching circuit arranged between the second terminal of the first radio-frequency line and the first housing, wherein a terminal of the matching circuit is electrically connected with the first housing and a core wire in the first radio-frequency line is electrically connected with another terminal of the matching circuit at the second terminal of the first radio-frequency line.

Optionally, the matching circuit may include: a first resistor or capacitor with one terminal grounded and another terminal electrically connected with a first connection point; an adjustable capacitor with one terminal grounded and another terminal electrically connected with a second connection point; an adjusting circuit with a terminal electrically connected with the first connection point and another terminal electrically connected with the second connection point, wherein the first housing is electrically connected with the first connection point and the core wire in the first radio-frequency line is electrically connected with the second connection point at the second terminal of the first radio-frequency line.

Optionally, the electronic device may include a second conductive housing being insulated from the first housing. A shield layer in the first radio-frequency line is electrically connected with the second housing at the first terminal of the first radio-frequency line. The first housing and the second housing are configured as two antenna arms for communicating radio-frequency signals with the first wireless communication module via the first radio-frequency line.

Optionally, the electronic device may further include: a rotation connection mechanism configured for rotatably connecting the first housing and the second housing, wherein: a first conductive area and a second conductive area insulated from each other are arranged on the rotation connection mechanism; the first conductive area is electrically connected with the first housing; the second conductive area is electrically connected with the second housing; and the core wire in the first radio-frequency line is electrically connected with the first conductive area and the shield layer in the first radio-frequency line is electrically connected with the second conductive area at the second terminal of the first radio-frequency line.

Optionally, the electronic device may further include: an Electro-Static discharge protection circuit with one terminal electrically connected with the first housing and another terminal grounded.

Optionally, the electronic device may further include: a second wireless communication module with a second input interface; a second radio-frequency line with a first terminal and a second terminal, wherein the first terminal of the second radio-frequency line is electrically connected with the second input interface; a first filter circuit; a second filter circuit; and a matching circuit, wherein, a first terminal of the first filter circuit and a first terminal of the second filter circuit are electrically connected with the first housing via the matching circuit, respectively; the core wire in the first radio-frequency line is electrically connected with the second terminal of the first filter circuit at the second terminal of the first radio-frequency line; the core wire in the second radio-frequency line is electrically connected with the second terminal of the second filter circuit at the second terminal of the second radio-frequency line; and the first housing is configured as the antenna arm for communicating radio-frequency signals with the first wireless communication module via the matching circuit, the first filter circuit, and the first radio-frequency line, and communicating radio-frequency signals with the second wireless communication module via the matching circuit, the second filter circuit, and the second radio-frequency line.

Embodiments of the present invention may have the following advantages.

In the electronic device according to an embodiment of the present invention, the current delivery path configured to deliver the high-frequency current is formed on the metal component as the antenna arm, so that the high-frequency current can be delivered in accordance with the predetermined path along the current delivery path on the first housing, which satisfies the practical requirement.

According to an embodiment of the present invention, patches with certain dielectric constants are attached to a surface of the conductive housing as the antenna arm to influence the high-frequency current. As a result, the current is not delivered uniformly from a feed point as a center. Instead, the current energy is delivered to a predetermined area as much as possible to satisfy requirement on conductance performance or radiation.

In the electronic device according to an embodiment of the present invention, the conductive housing of the electronic device is configured as the antenna arm for wireless transmission. The wireless communication module is connected with the conductive housing via the radio-frequency line for communicating the radio-frequency signals between the wireless communication module and the conductive housing. This implements the antenna function with a lower cost.

Also, it is not necessary to manufacture the housing in a plastic-metal integration manner because electromagnetic free space is not necessary on the metal housing. This improves material texture and structural strength.

Further, the electrical connection between the radio-frequency line and the conductive housing is implemented by a rotation mechanism connected with the housing. The rotation mechanism may have a metal rotation spindle electrically connected with a first conductive area on a spindle container. The spindle container may have a second conductive area insulated from the first conductive area and electrically connected with the second housing. Such an arrangement is easy to implement by altering the rotation connection mechanism instead of the whole electronic device.

According to an embodiment of the present invention, the matching circuit may include an adjustable capacitor and/or adjustable inductor, so that adaptive matching of the impedance of the antenna can be achieved by adjusting the adjustable capacitor and/or adjustable inductor when the impedance is changed. In this way, impedance matching is improved and power loss is reduced.

DETAILED DESCRIPTION OF THE EMBODIMENTS

In an electronic device according to an embodiment of the present invention, a current delivery path for delivering high-frequency current is formed on a metal component configured as an antenna arm, so that the high-frequency current can be delivered in accordance with a predetermined path along the current delivery path. In this way, influence on the performance of the antenna close to a hand/human body can be avoided when the electronic device is held by or close to a user, so that the antenna performance can be improved.

According to an embodiment of the present invention there is provided an electronic device, including a metal component configured as an antenna arm with a current delivery path for delivering high-frequency current formed thereon, so that the high-frequency current is delivered in accordance with a predetermined path along the current delivery path on the metal component.

Due to this current delivery path, the high-frequency current can be delivered in accordance with the predetermined path along the current delivery path on the metal component.

According to an embodiment of the present invention, the current delivery path may be formed in various ways. Embodiments of the present invention may be applied to general antenna and also to an antenna formed by a housing of the electronic device. Specific examples are as follows.

<General Antenna>

An embodiment of the present invention will be illustrated by using an inverse-F antenna, which is commonly used, as an example.

The inverse-F antenna is an antenna developed since the end of the last century. It has some unique advantages such as simple structure, light weight, conformal, low manufacture cost, high radiation efficiency, and multiband operation. As such, the inverse-F antenna has be widely researched and developed in recent years.

The antenna is electrically similar to a circuitry network including inductors, capacitors, and resistors, so the characteristics (e.g., impedance, frequency, and efficiency, etc.) of the whole antenna will be changed when any one of the inductors, capacitors, and resistors changes.

Figure 1:
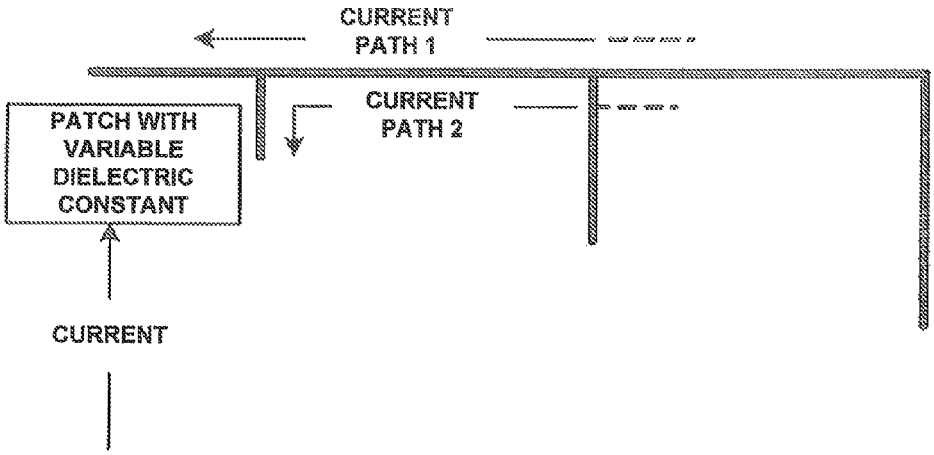
FIG. 1 schematically shows a diagram illustrating influence of a patch on a current patch of an inverse-F antenna.

FIG. 1 schematically shows a diagram illustrating influence of a patch on a current patch of an inverse-F antenna. When a hand (or another object) is close to the antenna or covers the antenna directly, the characteristics of the antenna will be changed. Generally, a current path of the antenna without a patch having a controllable dielectric constant is shown in FIG. 1. High-frequency current may be delivered along the current path 1. However, when the hand is close to the antenna or covers the antenna directly, the characteristics of the antenna will be changed, causing degradation of antenna performance.

In light of the foregoing it can be seen that when the hand (or another object) is close to the antenna or covers the antenna directly, the characteristics of the antenna will be changed. Similarly, a patch having a certain dielectric constant will also change the characteristics of the antenna. Therefore, according to specific embodiments of the present invention, compensation can be achieved by arranging a patch with a controllable dielectric constant.

The dielectric constant of the patch with the controllable dielectric constant may change from a first dielectric constant to a second dielectric constant when power is supplied thereto. When the constant of the patch is the first dielectric constant, the patch has very little influence on the antenna performance. However, when the dielectric constant of the patch is the second dielectric constant, its influence on the antenna performance may increase to compensate degradation of the antenna performance caused by the hand.

According to an embodiment of the present invention, the dielectric constant of the patch with the controllable dielectric constant may change from the first dielectric constant to the second dielectric constant when power is supplied thereto. At this time, the current delivery path on the antenna is changed by the patch and the hand so that the high-frequency current will be delivered along a current path 1 or the characteristics of the current path 2 will be changed. In this way, the degradation of the antenna performance caused by the hand can be compensated.

According to an embodiment of the present invention, the first dielectric constant, the second dielectric constant, and the location of the patch can be determined by experiment as follows.

First, a patch with a controllable dielectric constant that does not have any influence on the antenna performance when no power is supplied thereto is selected from a plurality of patches with formed of different materials.

After the patch is selected, the location and exciting current of the patch are adjusted continuously with a predetermined portion of the antenna being covered to test the antenna performance until the location and exciting current of the patch corresponding to the antenna performance satisfying the practical requirement are determined.

Finally, the patch is attached to the determined location and the determined exciting current is recorded. In practice, when the hand is detected to cover the predetermined location, the patch is supplied with the recorded exciting current so that the current path of the antenna can be changed to compensate the degradation of the antenna performance caused by the hand.

The patch may have different dielectric constants to compensate for different hold locations. The above experiment can be repeated by changing the covered location of the antenna that is covered to obtain different dielectric constants (exciting current) corresponding to the different locations. Then current is supplied to the patch according to the detected covered location to compensate the antenna performance caused by the hand.

According to another embodiment of the invention, the location of the patch used for compensation can be determined by simulation.

Further, the hold location may be detected by pressure sensor arranged around the antenna. Detailed description is omitted.

In the electronic device according to an embodiment of the present invention, the current delivery path 2 for delivering the high-frequency current is formed on the metal component so that the high-frequency current can be delivered in accordance with the predetermined path along the current delivery path on the metal component. In this way, the degradation of the antenna performance caused by the hand can be compensated so as to improve the antenna performance.

<Antenna Formed by Housing of Electronic Device>

Currently, in an electronic device with a housing formed of metal or other conductive materials, an electromagnetic free space is cut in the housing to place the antenna in order to obtain desirable wireless transmission/reception effect. However, such a structure will affect industrial design and product appearance disadvantageously, increase product cost, and reduce structure strength.

In order to solve the above problem, the housing is manufactured in plastic-metal integration manner in the prior art. However, this also increase the product cost and affect the texture of the metal housing greatly.

In view of this, according to an embodiment of the present invention, a conductive housing is used for wireless signal transmission to reduce the product cost and improve the texture and structure strength of the material.

According to an embodiment of the present invention there is provided an electronic device, including a first housing, a wireless communication module, and first radio-frequency line. The first housing is a conductive housing. The first wireless communication module has a first input interface. The first radio-frequency line has a first terminal and a second terminal. The first terminal of the first radio-frequency line is electrically connected with the first input interface, and the second terminal of the first to radio-frequency line is connected with the first housing. The first housing is configured as an antenna arm for communicating radio-frequency signals with the first wireless communication module via the first radio-frequency line.

The current path can be set in two ways when the housing of the electronic device is configured as the antenna.

Figure 2:
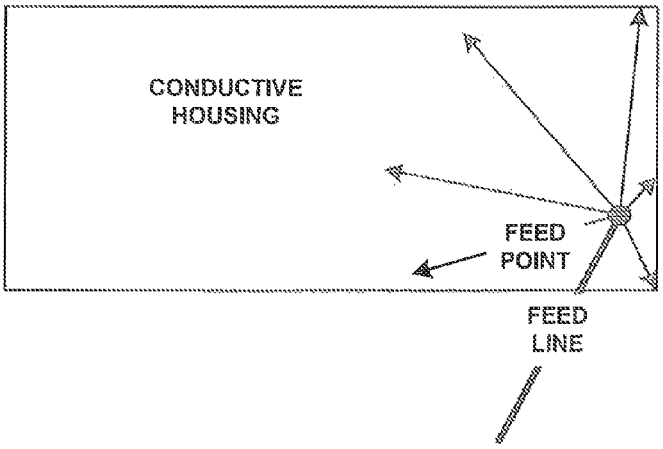
FIG. 2 schematically shows a diagram illustrating current delivery when a conductive housing without a patch is configured as an antenna arm.

FIG. 2 schematically shows a diagram illustrating current delivery when a conductive housing without a patch is configured as an antenna arm. When the conductive housing has a consistent dielectric constant and no patch attached thereto, the current delivery path on the conductive housing extends radially from a feed point, as shown in FIG. 2. Signals closer to the edge of the housing are more prone to go into space.

According to an embodiment of the present invention, a patch with a fixed dielectric constant is attached to the surface of the housing to improve the antenna performance when the conductive housing is configured as the antenna arm.

Figure 3:
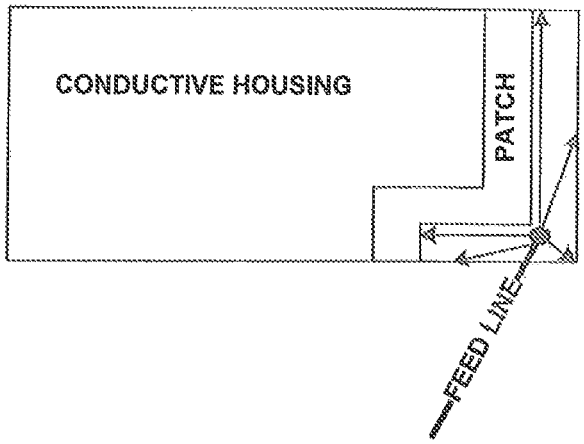
FIG. 3 schematically shows a diagram illustrating current delivery when a conductive housing with a patch is configured as an antenna arm.

FIG. 3 schematically shows a diagram illustrating current delivery when a conductive housing with a patch is configured as an antenna arm. As shown in FIG. 3, the dielectric constant of the patch is higher than that of the housing. Therefore, the current will be influenced by the patch and is not delivered uniformly from the feed point. Instead, the current energy will concentrate toward periphery of the conductive housing so that space radiation efficiency can be improved.

The foregoing arrangement can improve the transmission performance of the antenna. However, under certain circumstances, the user may consider more about the radiation performance of the antenna rather than its transmission performance. In this case, it is preferable that less signal are radiated into the space. This can be achieved by the patch as shown in FIG. 4.

Figure 4:
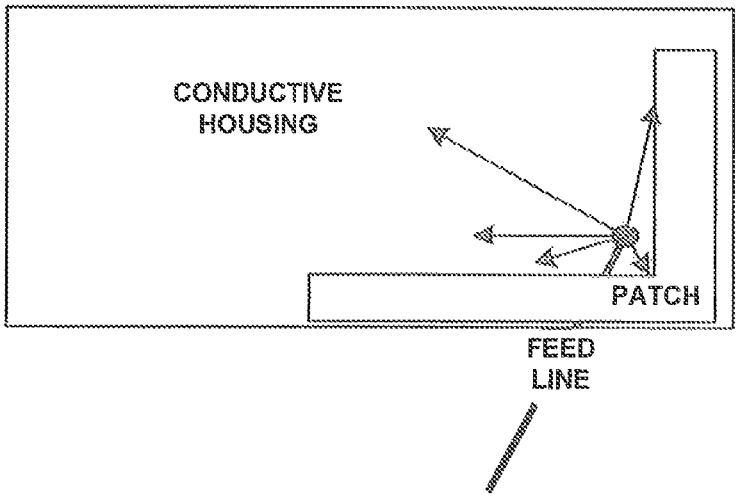
FIG. 4 schematically shows another diagram illustrating current delivery when a conductive housing without a patch is configured as an antenna arm.

FIG. 4 schematically shows another diagram illustrating current delivery when a conductive housing without a patch is configured as an antenna arm. As shown in FIG. 4, the dielectric constant of the patch is higher than that of the housing. Therefore, the current energy will concentrate toward a centre of the housing rather than its periphery. In this way, radiation energy toward the space is reduced.

In the above embodiment, the delivery path is formed by attaching the patch. However, it should be understood that the current delivery path may also be formed by making the first housing to have different dielectric constants at different locations during its manufacture process.

In the example shown in FIG. 3, a material having controllable dielectric constant may be used at the location of the conductive housing covered by the patch.

As mentioned above, the current should be delivered toward the periphery of the housing to achieve better antenna performance. The current should be delivered toward the center of the housing to reduce radiation. Therefore, according to an embodiment of the present invention, a plurality of current delivery path may be formed on the first housing and respective connections between the second terminal of the first radio-frequency line (feed line) and the different current delivery path can be turned on as desired to meet different requirements.

Figure 5:
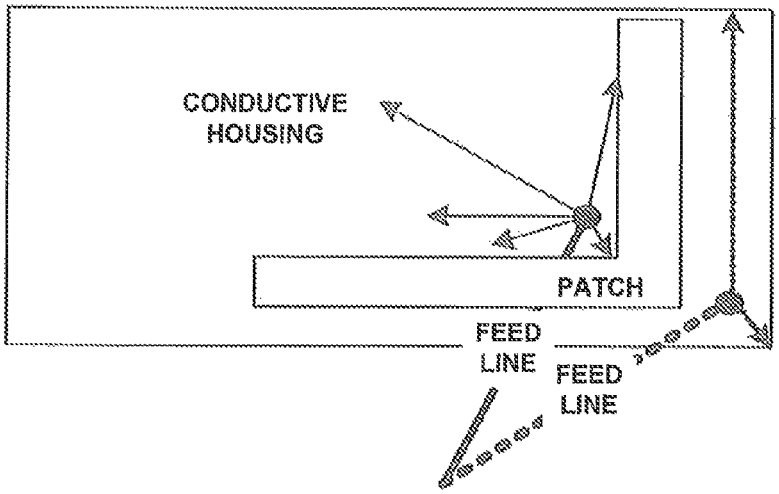
FIG. 5 schematically shows a diagram illustrating different paths selected according to different requirements when the conductive housing is configured as the antenna arm.

FIG. 5 schematically shows a diagram illustrating different paths selected according to different requirements when the conductive housing is configured as the antenna arm. As shown in FIG. 5, two paths are formed by the patch and two feed points are arranged. When it is desirable to reduce radiation, an electrical connection between the second terminal of the first radio-frequency line and the feed point above the patch is turned on by a conduction control component. When it is desirable to improve antenna performance, an electrical connection between the second terminal of the first radio-frequency line and the feed point on the right side of the patch is turned on by the conduction control component.

In order to address the aforementioned problem that the antenna performance is influenced by the hand, the electronic device according to an embodiment of the present invention may also include a detection component and a conductive control component.

The detection component is configured to detect a location of the first housing that is held by the hand. The conductive control component is configured to turn on the electrical connection between the second terminal of the first radio-frequency line and a first current delivery path according to the detection result of the detection component. The first current delivery path is a current delivery path outside the location held by the hand among the plurality of current delivery paths.

In the electronic device according to an embodiment of the present invention, the conductive housing in the electronic device is configured as the antenna arm for wireless transmission. The wireless communication module and the conductive housing are connected by the radio-frequency line for communicating radio-frequency signals therebetween. This can reduce product cost and improve material texture and structure strength while implementing the antenna function. In other words, an electronic device according to an embodiment of the present invention as shown in FIGS. 7-12 may use only a conductive housing as an antenna arm for wireless transmission. A wireless communication module and a conductive housing are connected by a radio-frequency line for communicating radio-frequency signals therebetween. Meanwhile, a current delivery path for delivering high-frequency current may be formed on the conductive housing, so that the high-frequency current can be delivered in accordance with a predetermined path along the current delivery path on the conductive housing (i.e., the metal component). In this way, the bandwidth of the antenna using the conductive housing as the antenna arm for wireless transmission can be expanded.

Figure 7:
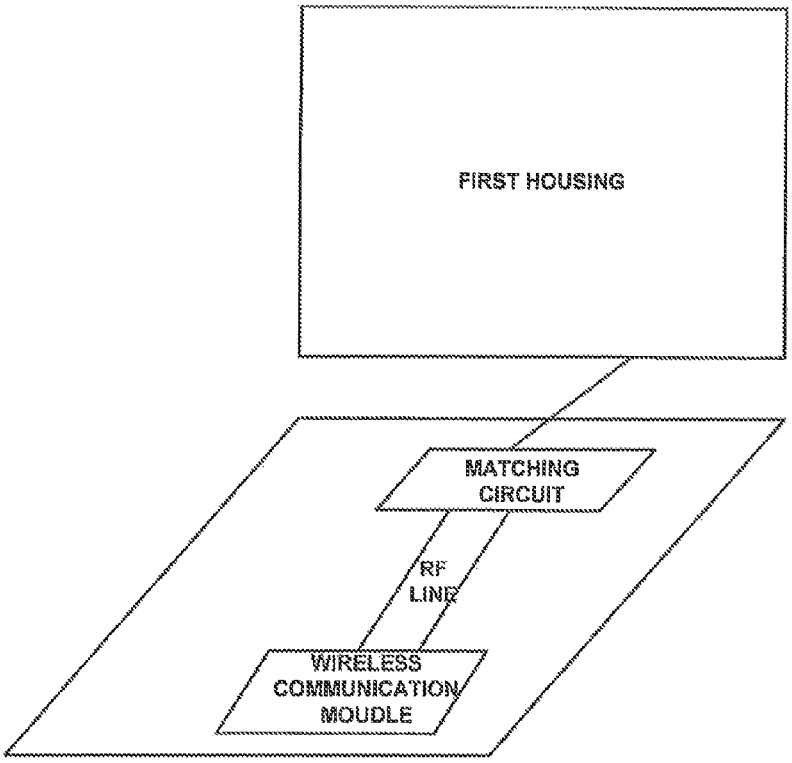
FIG. 7 schematically shows a structural diagram where a first housing is configured as a monopole antenna in an electronic device according to an embodiment of the present invention.

FIG. 7 schematically shows a structural diagram where a first housing is configured as a monopole antenna in an electronic device according to an embodiment of the present invention. As shown in FIG. 7, the electronic device according to the present invention includes a first housing, a first wireless communication module, and a first radio-frequency line, etc. The first housing is a conductive housing. The first wireless communication module includes a first input interface. The first radio-frequency line includes a first terminal and a second terminal. The first terminal of the first radio-frequency line is electrically connected with the first input interface. The second terminal of the first radio-frequency line is electrically connected with the first housing.

The first housing is configured as an antenna arm for communicating radio-frequency signals with the first wireless communication module via the first radio-frequency line.

The first wireless communication module may be a wireless communication module providing WCDMA communication service or a wireless communication module providing WiFi communication service or a wireless communication module providing TD-SCDMA communication service. It may also be a wireless communication module providing other wireless communication services (e.g., terrestrial digital TV service), etc.

Generally, the electronic device includes at least two housings, i.e., a first housing and a second housing. For example, a notebook computer includes a first housing for mounting an LCD screen and a second housing for mounting a main board. A mobile phone, such as a flip phone or slide phone, includes a first housing for mounting an LCD screen and a second housing for mounting a main board. Devices such as a bar phone or PAD also have two housings.

Generally, there are two types of antennas for transmitting wireless communication signals: monopole antenna and dipole antenna. Embodiments of the present invention may be applied to both the monopole antenna and the dipole antenna. Detailed description is as follows.

<Monopole Antenna>

In case where the first housing and the second housing are both conductive housings, either housing may be used as the antenna arm to form the monopole antenna. An example is described as follows using the first housing as the antenna arm.

Figure 6:
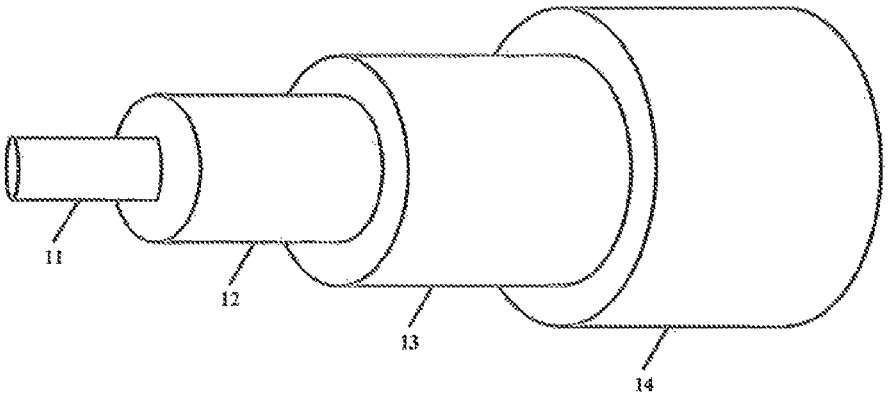
FIG. 6 schematically shows a structure of a radio-frequency line.

FIG. 6 schematically shows a structure of a radio-frequency line. As shown in FIG. 6, the radio-frequency line includes:

a core wire 11;

a first insulation layer 12 cladding the core wire 11;

a shield layer 13 formed by a conductive material cladding the insulation layer 12; and a second insulation layer 14 cladding the shield layer 13.

According an embodiment of the present invention, a first wireless communication module includes a first input interface. A first radio-frequency line includes a first terminal and a second terminal. An electrical connection between the radio-frequency line and the first wireless communication module is implemented by inserting the first terminal of the first radio-frequency line into the first input interface.

The second terminal of the first radio-frequency line is connected to the antenna arm, i.e., the first housing. As shown in FIG. 6, the first radio-frequency line includes two conductors: the core wire 11 and the shield layer 13. In the case of the monopole, the core wire 11 is electrically connected with the first housing at the second terminal of the first radio-frequency line and the shield layer 13 is floating, i.e., the shield layer 13 is not connected to any other device.

After the first radio-frequency line is connected with the first wireless communication module at one terminal and with the first housing at the other terminal, an electrical connection is established between the first wireless communication module and the first housing via the first radio-frequency line for communicating radio-frequency signals. The first housing may transmit/receive signals as a monopole antenna.

FIG. 7 schematically shows a structural diagram where a first housing is configured as a monopole antenna in an electronic device according to an embodiment of the present invention.

<Dipole Antenna>

In case where the first housing and the second housing are both conductive housings and electrically insulated from each other, the first and second housings may be used as antenna arms together to form a dipole antenna. Detailed description is as follows.

FIG. 6 schematically shows a structure of a radio-frequency line. As shown in FIG. 6, the radio-frequency line includes:

a core wire 11;

a first insulation layer 12 cladding the core wire 11;

a shield layer 13 formed by a conductive material cladding the insulation layer 12; and a second insulation layer 14 cladding the shield layer 13.

According an embodiment of the present invention, a first wireless communication module includes a first input interface. A first radio-frequency line includes a first terminal and a second terminal. An electrical connection between the radio-frequency line and the first wireless communication module is implemented by inserting the first terminal of the first radio-frequency line into the first input interface.

The second terminal of the first radio-frequency line is connected to the antenna arm, i.e., the first housing. As shown in FIG. 6, the first radio-frequency line includes two conductors: the core wire 11 and the shield layer 13. In the case of the monopole, the core wire 11 is electrically connected with the first housing at the second terminal of the first radio-frequency line and the shield layer 13 is electrically connected with the second housing.

After the first radio-frequency line is connected with the first wireless communication module at one terminal and with the first and second housings at the other terminal, an electrical connection is established between the first wireless communication module and the first and second housings via the first radio-frequency line for communicating radio-frequency signals. The first and second housings may cooperate to transmit/receive signals as a dipole antenna.

According to an embodiment of the present invention, the core wire/shield layer in the first radio-frequency line may be electrically connected with the first housing/second housing directly. When the first wireless communication module has been determined, the connection point between the core wire/shield layer and the first housing/second housing may be determined by test or simulation to meet desirable requirement.

Many electronic devices have a rotation connection mechanism, via which the first housing and the second housing are connected in a rotatable way. For example, the two housings of the notebook computer are rotatably connected via a rotation spindle.

According to an embodiment of the present invention, the core wire and/or shield layer in the first radio-frequency line may be electrically connected with the housing via a soft connection line. However, in order to save space and avoid too much alteration to existing product structure, the core wire and/or shield layer may be electrically connected with the housing via the rotation connection mechanism. Cases for the monopole antenna and the dipole antenna are described as follows, respectively.

<Monopole Antenna>

In case where the first housing forms a monopole antenna, a first conductive area is arranged on the rotation connection mechanism. The first conductive area is electrically connected with the first housing and electrically insulated from the second housing. The core wire in the first radio-frequency line is electrically connected with the first conductive area at the second terminal of the first radio-frequency line. The shield layer is floating.

<Dipole Antenna>

In case where the first housing and the second housing together form the dipole antenna, a first conductive area and a second conductive area insulated from each other are arranged on the rotation connection mechanism. The first conductive area is electrically connected with the first housing. The second conductive area is electrically connected with the second housing. The core wire in the first radio-frequency line is electrically connected with the first conductive area at the second terminal of the first radio-frequency line. The shield layer in the first radio-frequency line is electrically connected with the second conductive area.

When the core wire and the shield layer in the first radio-frequency line are connected with the first housing and the second housing via the conductive areas on the rotation connection mechanism, performance may be optimized by adjusting respective locations of the conductive areas on the rotation connection mechanism.

In the above embodiment, the rotation spindle connected with the first housing may be designed as a metal spindle and electrically connected with a first conductive area on a spindle container. A second conductive area on the spindle container is insulated from the first conductive area and electrically connected with the second housing. As a result, the structure is simple and only the rotation connection mechanism, rather than the whole electronic device, needs to be changed.

According to an embodiment of the present invention, when the conductive housing is configured as the antenna arm, the electronic device also includes a matching circuit for improving impedance matching and reducing power loss. The matching circuit is arranged between the second terminal of the first radio-frequency line and the first housing. One terminal of the matching circuit is electrically connected with the first housing. At the second terminal of the first radio-frequency line, the core wire in the first radio-frequency line is electrically connected with the other terminal of the matching circuit.

In case of the monopole antenna, the shield layer in the first radio-frequency line is floating at the second terminal of the first radio-frequency line. In case of the dipole antenna, the shield layer in the first radio-frequency line is electrically connected with the second housing at the second terminal of the first radio-frequency line.

In case of the above-described rotation connection mechanism, the other terminal of the matching is electrically connected with the first housing via the first conductive area.

However, when the housing as the antenna arm is touched by the user, the impedance of the antenna may change. In such a case, the matching circuit is an adjustable circuit to implement adaptive impedance adjustment.

Figure 8:
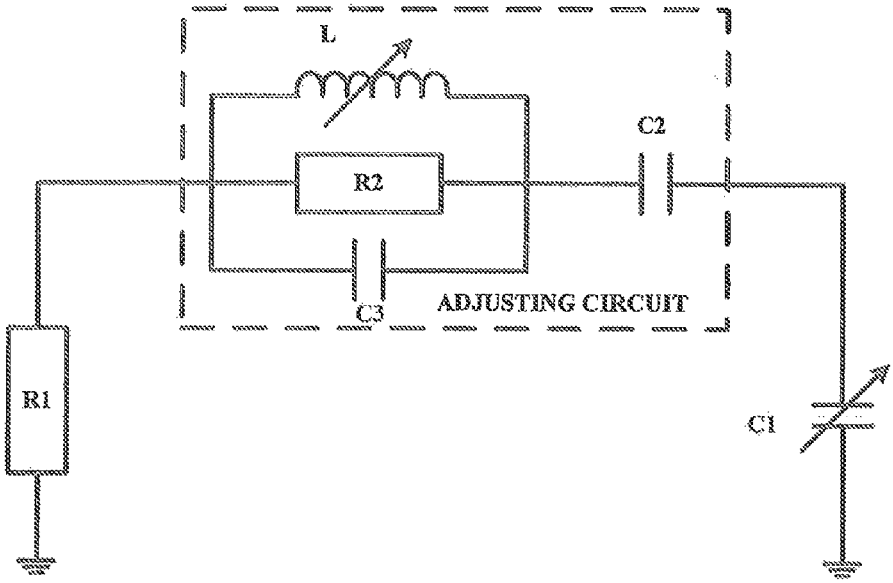
FIG. 8 schematically shows a structural diagram of a matching circuit according to an embodiment of the present invention.

FIG. 8 schematically shows a structural diagram of a matching circuit according to an embodiment of the present invention. As shown in FIG. 8, the matching circuit includes a first resistor R1, an adjustable capacitor C1, and an adjusting circuit.

One terminal of the first resistor R1 is grounded. The other terminal of the first resistor R1 is electrically connected with a first connection point (the left black point in the figure). The resistor can be replaced with a capacitor.

One terminal of the adjustable capacitor C1 is grounded. The other terminal of the adjustable capacitor C1 is electrically connected with a second connection point (the right black point in the figure).

One terminal of the adjusting circuit is electrically connected with the first connecting point. The other terminal of the adjusting circuit is electrically connected with the second connecting point.

The first housing is electrically connected with the first connecting point. The core wire in the first radio-frequency line is electrically connected with second connecting point at the second terminal of the first radio-frequency line.

The adjusting circuit includes at least one adjustable component such as an adjustable inductor or an adjustable capacitor. A specific embodiment is described as follows.

As shown in FIG. 8, the adjusting circuit includes a parallel circuit and a second capacitor C2 connected in series. The parallel circuit includes an adjustable inductor, a second resistor, and a third capacitor connected in parallel.

In the circuit shown in FIG. 8, when impedance of the antenna changes, the adjustable capacitor C1 and/or the adjustable inductor may be adjusted to implement adaptive impedance matching so as to improve impedance matching and reduce power loss.

The electronic device according to an embodiment of the present invention further includes an Electro-Static discharge protection (ESD) circuit for Electro-Static discharge protection. One terminal of the ESD protection circuit is electrically connected with the first housing. The other terminal of the ESD protection circuit is grounded.

Figure 9:
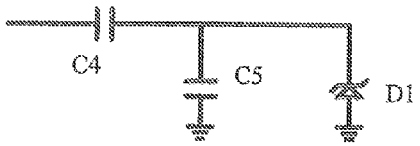
FIG. 9 schematically shows a structural diagram of an ESD protection circuit according to an embodiment of the present invention.

FIG. 9 schematically shows a structural diagram of an ESD protection circuit according to an embodiment of the present invention. As shown in FIG. 9, the ESD protection circuit includes a fourth capacitor C4, a fifth capacitor C5, and an ESD protection device D1.

One terminal of the fourth capacitor C4 is electrically connected with the first housing. The other terminal of the capacitor C4 is grounded via the ESD protection device D1. One terminal of the fifth capacitor C5 is grounded. The other terminal of the fifth capacitor C5 is connected to a connection line between the fourth capacitor C4 and the device D1. The ESD protection circuit is combined with a matching network. The adjustable capacitor C1 is capacitance of the matching network. The fifth capacitor C5 is parasitic capacitance of the ESD protection device D1.

The ESD protection circuit and the matching circuit may operate separately or together.

The above embodiments include one wireless communication module. However, it should be understood that the same conductive housing may be used to provide reception/transmission service to different wireless communication modules according to embodiments of the present invention. Specific examples are as follows.

An electronic device according to an embodiment of the present invention includes a first housing, which is a conductive housing, wherein the electronic device further includes:

a first wireless communication module with a first input interface;

a second wireless communication module with a second input interface;

a first radio-frequency line with a first terminal and a second terminal, wherein the first terminal of the first radio-frequency line is electrically connected with the first input interface, and the second terminal of the first radio-frequency line is electrically connected with the first housing;

a second radio-frequency line with a first terminal and a second terminal, wherein the first terminal of the second radio-frequency line is electrically connected with the second input interface, and the second terminal of the second radio-frequency line is to electrically connected with the first housing;

wherein the first housing is configured as an antenna arm for communicating radio-frequency signals with the second wireless communication module via the first radio-frequency line.

Considering that different wireless communication modules may operate in different frequency bands, the electronic device according to an embodiment of the present invention may further includes:

a first filter circuit, wherein signals filtered by the first filter circuit are in an operation band of the first wireless communication module;

a second filter circuit, wherein signals filtered by the second filter circuit are in an operation band of the second wireless communication module;

a matching circuit;

a first terminal of the first filter circuit and a first terminal of the second filter circuit are electrically connected with the first housing via the matching circuit, respectively;

the core wire in the first radio-frequency line is electrically connected with a second terminal of the first filter circuit at the second terminal of the first radio-frequency line;

the core wire in the second radio-frequency line is electrically connected with a second terminal of the second filter circuit at the second terminal of the second radio-frequency line, wherein the first housing is configured as an antenna arm for communicating radio-frequency signals with the first wireless communication module via the matching circuit, the first filter circuit, and the first radio-frequency line, and for communicating radio-frequency signals with the second wireless communication module via the matching circuit, the second filter circuit, and the second radio-frequency line.

The first wireless communication module may be a 3G full-band wireless communication module. The second wireless communication module may be a WiFi wireless communication module. Specific examples are as follows.

Figure 10:
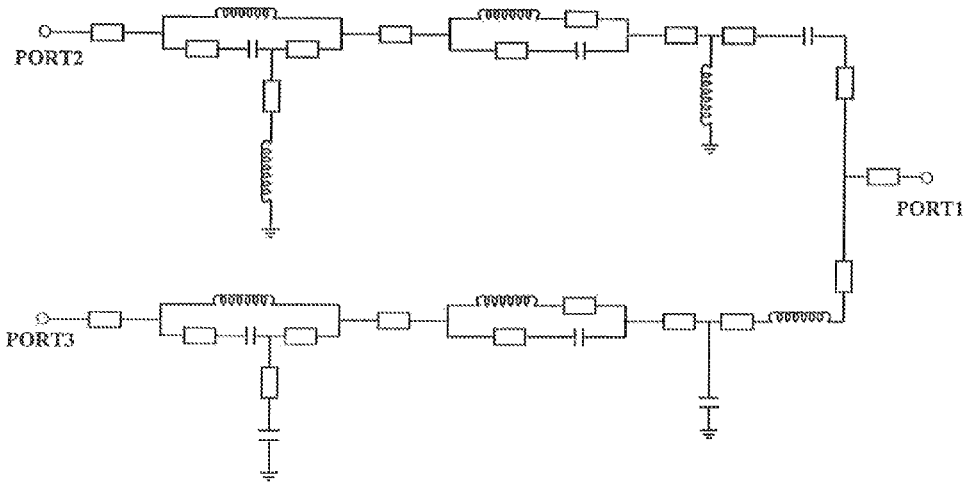
FIG. 10 schematically shows a structural diagram of an implementation of a filter circuit according to an embodiment of the present invention.

FIG. 10 schematically shows a structural diagram of an implementation of a filter circuit according to an embodiment of the present invention. As shown in FIG. 10, a port 2 and a port 3 are connected with the first radio-frequency line and the second radio-frequency line, respectively. A port 1 is connected with a matching circuit. The matching circuit outputs signals to an upper circuit and a lower circuit, respectively. The upper circuit and the lower circuit output respective signals to the first radio-frequency line and the second radio-frequency line and then to the 3G full-band wireless communication module and the WiFi wireless communication module. The signals output from the port 2 and the port 3 have been frequency-filtered and better effect can be achieved.

Signals of different frequency bands can be filtered out by selecting parameters of the resistors, capacitors, and inductors shown in FIG. 9 in order to meet requirement of the wireless communication module. It should be noted that the above-described circuit structure can be varied and is not limited to the specific one shown in FIG. 9.

If there are three or more wireless communication modules, the circuit may be simply modified to include more parallel filter circuits. Detailed description is omitted.

The above-described circuits may all be arranged separately or integrated on a main board, which will not influence the effect achieved by the embodiments. Detailed description is omitted.

In the above embodiments, the high-frequency current flows on the first housing. However, in the embodiments shown in FIGS. 7-10, the high-frequency current may not flow on the first housing. The first housing is only used as the antenna arm of the antenna for receiving or transmitting radio-frequency signals.

Figure 11:
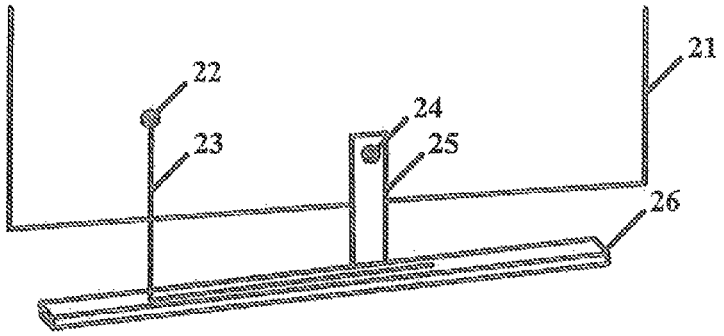
FIG. 11 schematically shows a structural diagram where the first housing and a first conductor are shorted according to an embodiment of the present invention.

FIG. 11 schematically shows a structural diagram where the first housing and a first conductor are shorted according to an embodiment of the present invention. In an electronic device according to an embodiment of the present invention, a conductive housing in the electronic device is configured as an antenna arm for wireless transmission. A wireless communication module and the conductive housing are connected via a radio-frequency line for communicating radio-frequency signals therebetween. This reduces product cost and improves material texture and structure strength while implement the antenna function.

The electronic device shown in FIG. 11 includes a first housing, which is a conductive housing. The electronic device further includes a first wireless communication module, a first radio-frequency line and a first conductor.

The first wireless communication module includes an input interface. The first radio-frequency line includes a first terminal and a second terminal. The first terminal of the first radio-frequency line is electrically connected with the input interface. The second terminal of the first radio-frequency line is electrically connected with the first housing. The first conductor is grounded and spaced from the first housing by a certain distance.

A core wire in the first radio-frequency line is electrically connected with the first housing at the second terminal of the first radio-frequency line. A shield layer in the first radio-frequency line is electrically connected with the first conductor. The first wireless communication module receives/transmits radio-frequency signals via the first housing and the first conductor.

FIG. 6 shows an embodiment of the radio-frequency line. The radio-frequency line includes: a core wire 11; a first insulation layer 12 cladding the core wire 11; a shield layer 13 formed of a conductive material cladding the insulation layer 12; and a second insulation layer 14 cladding the shield layer 13.

The first wireless communication module may be a wireless communication module providing WCDMA communication service, a wireless communication module providing WiFi communication service, or a wireless communication module providing TD-SCDMA communication service. It may also be a wireless communication module providing other wireless communication services (e.g., terrestrial digital TV service), etc. The wireless communication modules of different communication systems only differ in response frequency bands. There is no difference in the operation manner of the antenna.

According to an embodiment of the present invention, the first conductor may be mounted on the first housing via an insulating component. There is no requirement on the relative position of the first conductor with respect to the first housing. They may or may not be parallel to each other.

The conductor may be connected to the ground of the electronic device (e.g., main board ground) or to the ground of the wireless communication module via the shield layer of the radio-frequency line.

Figure 12:
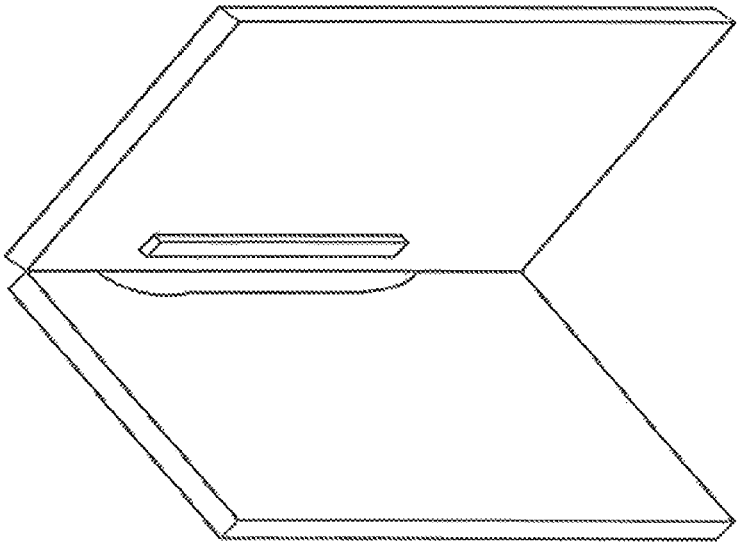
FIG. 12 schematically shows a diagram illustrating a protruding structure and a groove structure on a housing of a mounting board.

According to an embodiment of the present invention, when the first conductor is arranged in a housing with a display screen of the electronic device, the first conductor may be a metal sheet as shown in FIG. 12 to reduce influence of parasitic capacitance generated by opposite parts of the first conductor and the first housing. The first conductor is perpendicular to the metal housing. A smaller side of the metal sheet is opposite to the first housing so that the opposite areas of the first conductor and the metal housing are reduced to reduce the parasitic capacitance.

In such a case, the first conductor is perpendicular to the metal housing (the first housing). Considering the size of the antenna, when the height of the first conductor is less than that of the housing with the display screen, there is no problem with such a structure. However, when the height of the first conductor is larger than that of the housing with the display screen, a protruding structure should be arranged on a side of the housing, on which the display screen is mounted, to accommodate the portion of the first conductor that is higher than the housing. In this way, the appearance of the electronic device can be kept integrated in its close state.

Considering the first housing and the second housing are rotatably connected with each other, the first conductor is arranged on a portion between two rotation connection mechanisms of the housing.

Considering the first housing and the second housing are rotatably connected with each other, the protruding structure should not collide the lower housing for the main board during rotation. In this case, a groove (e.g., an arc-shaped groove) should be arranged in the housing for the main board so that the protruding structure will not collide the lower housing for the main board during rotation, as shown in FIG. 12.

Generally, the electronic device includes at least two housings, i.e., a first housing and a second housing. For example, a notebook computer includes a first housing for mounting an LCD screen and a second housing for mounting a main board. A mobile phone, such as a clamshell or cover-slide phone, includes a first housing for mounting an LCD screen and a second housing for mounting a main board. Devices such as straight-plate phone or PAD also have two housings.

FIG. 12 schematically shows a diagram illustrating a protruding structure and a groove structure on a housing of a mounting board.

According to an embodiment of the present invention, the first housing is configured as a radiation branch of the antenna. The first conductor is connected with the ground of the electronic device to function as antenna ground. The core wire in the radio-frequency line is electrically connected with the first housing. The shield layer in the first radio-frequency line is electrically connected with the first conductor. In this way, the antenna function is implemented by the metal housing with reduced product cost. Meanwhile, it is not necessary to cut an electromagnetic free space in the metal housing or manufacture the housing in a plastic-metal integration manner. This improves material texture and structure strength.

The above core wire is used for transmitting radio-frequency signals and thus is electrically connected with the first housing as a radiation surface. The shield layer is electrically connected with the first conductor as the antenna ground.

The arrangement of the position of the feed point between the core wire and the first housing and the position of the connection point between the shield layer and the first conductor is relative to factors such as response frequency of the antenna, area of the first housing, distance between the first conductor and the first housing, and opposite area between the first conductor and the housing, etc. A simple description is as follows.

A known equation of frequency resonation is as follows: $f=1/(2\pi(LC)^{1/2})$.

The antenna can be deemed as an oscillator. When the area of the first housing fixed, the inductance L and the capacitance C can be changed by adjusting the position of the feed point, the distance between the first conductor and the first housing, and the opposite area between the first conductor and the housing, etc, so that the antenna can operate at a proper frequency band.

In the above antenna structure, the first conductor should be long enough so that the antenna can operate at the proper frequency band. However, in order to meet the trend of minimizing the size of the electronic device, the length of the first conductor should be reduced. According to an embodiment of the present invention, the electronic device further includes a second conductor 25, as shown in FIG. 12. One terminal of the second conductor 25 is electrically connected with the first conductor 26. The other terminal of the second conductor is electrically connected with the first housing 21.

The second conductor 25 forms a short connection between the first conductor 26 and the first housing 21. The second conductor 25 is electrically connected with the first housing 21 via a solder point 24. The shield layer of the radio-frequency line 23 is connected with the first conductor 26. The core wire of the radio-frequency line 23 is connected with the first housing 21 at the feed point 23.

The second conductor 25 forms the 26 short connection between the first conductor 26 and the first housing 21. In this way, the first housing 21 and the first conductor 26 form a PIFA antenna, which reduces the length of the second conductor. The antenna is thus minimized to be adapted for more types of electronic devices.

According an embodiment of the present invention, when the conductive housing is configured as the antenna arm, the electronic device further includes the matching circuit as shown in FIG. 8 being arranged between the second terminal of the first radio-frequency line and the first housing, in order to improve impedance matching and reduce power loss.

In this way, even when the impedance of the antenna is changed due to a user to touching the housing as the antenna arm, the change of the impedance can be compensated because certain parameters of the matching circuit, such as the inductance or capacitance, are adjustable.

Preferred embodiments of the present invention have been illustrated. It should be understood by those skilled in the art that various improvements and modifications can be made without departing from spirit of the present invention. All such improvements and modifications fall within the scope of the invention.

What is claimed is:

1. An electronic device, comprising:

a first housing, which is a conductive housing;

a first wireless communication module with a first input interface;

a first radio-frequency line with a first terminal and a second terminal, wherein the first terminal of the first radio-frequency line is electrically connected with the first input interface, and the second terminal of the first radio-frequency line is connected with the first housing; and a first conductor, which is grounded and spaced from the first housing by a distance, wherein the first housing is configured as an antenna arm for communicating radio-frequency signals with the first wireless communication module via the first radio-frequency line, wherein a core wire in the first radio-frequency line is electrically connected with the first housing and a shield layer in the first radio-frequency line is electrically connected with the first conductor at the second terminal of the first radio-frequency line, and wherein the first wireless communication module is configured for receiving and transmitting the radio-frequency signals via the first housing and the first conductor.

2. The electronic device according to claim 1, further comprising a second conductor with one terminal being electrically connected with the first conductor and another terminal being electrically connected with the first housing.

3. The electronic device according to claim 1, wherein a plurality of parts of the first housing have different dielectric constants to form the current delivery path.

4. The electronic device according to claim 1, wherein:

the first housing is formed of a material with a first dielectric constant or a conductive material;

a component formed of a material with a second dielectric constant is attached to the first housing to form the current delivery path on the first housing.

5. The electronic device according to claim 1, wherein a plurality of current delivery paths are formed on the first housing and the electronic device further comprises:

a detection component configured for detecting a part of the first housing that is held by or contacts a human being; and a conduction control component configured for turning on an electrical connection between the second terminal of the first radio-frequency line and a first current delivery path, the first current delivery path being a current delivery path outside the part of the first housing that is held by or contacts the human being.

6. The electronic device according to claim 1, further comprising a matching circuit arranged between the second terminal of the first radio-frequency line and the first housing, wherein a terminal of the matching circuit is electrically connected with the first housing and a core wire in the first radio-frequency line is electrically connected with another terminal of the matching circuit at the second terminal of the first radio-frequency line.

7. The electronic device according to claim 6, wherein the matching circuit comprises:

a first resistor or capacitor with one terminal grounded and another terminal electrically connected with a first connection point;

an adjustable capacitor with one terminal grounded and another terminal electrically connected with a second connection point;

an adjusting circuit with a terminal electrically connected with the first connection point and another terminal electrically connected with the second connection point, wherein the first housing is electrically connected with the first connection point and the core wire in the first radio-frequency line is electrically connected with the second connection point at the second terminal of the first radio-frequency line.

8. The electronic device according to claim 1, further comprises a second housing, which is a conductive housing being insulated from the first housing, wherein:

a shield layer in the first radio-frequency line is electrically connected with the second housing at the first terminal of the first radio-frequency line; and the first housing and the second housing are configured as two antenna arms for communicating radio-frequency signals with the first wireless communication module via the first radio-frequency line.

9. The electronic device according to claim 8, further comprising a rotation connection mechanism configured to rotatably connect the first housing and the second housing, wherein:

a first conductive area and a second conductive area insulated from each other are arranged on the rotation connection mechanism;

the first conductive area is electrically connected with the first housing;

the second conductive area is electrically connected with the second housing; and a core wire in the first radio-frequency line is electrically connected with the first conductive area and the shield layer in the first radio-frequency line is electrically connected with the second conductive area at the second terminal of the first radio-frequency line.

10. The electronic device according to claim 1, further comprising an Electro-Static discharge protection circuit with one terminal electrically connected with the first housing and another terminal grounded.

11. The electronic device according to claim 1, further comprising:

a second wireless communication module with a second input interface;

a second radio-frequency line with a first terminal and a second terminal, wherein the first terminal of the second radio-frequency line is electrically connected with the second input interface;

a first filter circuit;

a second filter circuit; and a matching circuit, wherein a first terminal of the first filter circuit and a first terminal of the second filter circuit are electrically connected with the first housing via the matching circuit, respectively;

the core wire in the first radio-frequency line is electrically connected with the second terminal of the first filter circuit at the second terminal of the first radio-frequency line;

the core wire in the second radio-frequency line is electrically connected with the second terminal of the second filter circuit at the second terminal of the second radio-frequency line; and the first housing is configured as the antenna arm for communicating radio-frequency signals with the first wireless communication module via the matching circuit, the first filter circuit, and the first radio-frequency line, and communicating radio-frequency signals with the second wireless communication module via the matching circuit, the second filter circuit, and the second radio-frequency line.

12. The electronic device according to claim 1, further comprising a second housing, which is grounded and rotatably connected with the first housing via a rotation connection mechanism, the rotation connection mechanism comprising:

a first conductive fastener configured as the first conductor, the first conductive fastener being fixed on and electrically connected with the second housing and having a spindle mounting groove;

a conductive spindle mounted in the spindle mounting groove and electrically connected with the first conductive fastener; and a second conductive fastener fixed to the first housing and rotatably connected with the conductive spindle, wherein the core wire in the first radio-frequency line is electrically connected with the conductive spindle and the shield layer in the first radio-frequency line is grounded via the first conductive fastener or the second housing at the second terminal of the first radio-frequency line.

13. The electronic device according to claim 1, wherein the first conductor is a metal sheet and a side of the metal sheet is opposite to the first housing.

* * * * *